United States Patent [19]

Labrecque

[11] Patent Number: 4,807,320

[45] Date of Patent: Feb. 28, 1989

[54] CHIMNEY BRUSH

[76] Inventor: Robert Labrecque, 34 Third St., Berlin, N.H. 03570

[21] Appl. No.: 109,206

[22] Filed: Oct. 16, 1987

[51] Int. Cl.[4] ..... F23J 3/00

[52] U.S. Cl. ..... 15/163; 15/243

[58] Field of Search ..... 15/162, 163, 242, 243, 15/249

[56] References Cited

U.S. PATENT DOCUMENTS

| | | | |
|---|---|---|---|
| 1,070,662 | 8/1913 | Bedford et al. | 15/249 |
| 4,490,876 | 1/1985 | Haberl | 15/163 |
| 4,505,000 | 3/1985 | Boehland et al. | 15/163 X |
| 4,538,317 | 9/1985 | Sorensen | 15/163 |

FOREIGN PATENT DOCUMENTS

| | | | |
|---|---|---|---|
| 2221436 | 11/1973 | Fed. Rep. of Germany | 15/163 |

*Primary Examiner*—Peter Feldman

*Attorney, Agent, or Firm*—Jerry T. Kearns

[57] ABSTRACT

A chimney brush is mounted between two pulleys within the chimney for reciprocation along the length of the chimney for cleaning deposits from the chimney flue liner. A first pulley is mounted by a bracket on the chimney cap. A second pulley is mounted below the stove connection or thimbol, adjacent an access door to the second pulley. A crank arm is provided for rotation of this lower pulley so that a brush attached to a looped cable between the upper and lower pulleys may be reciprocated along the length of the chimney. A spring connection is provided between the cable and the brush to compensate for any stretching or expansion of the cable due to heating. One of the pulleys has a V groove to ensure frictional driving engagement with the cable. When not in use, the brush is disposed beneath the stove connection or thimbol of the chimney, thus only the cable remains in the chimney, minimizing interference with the smoke flow within the chimney.

4 Claims, 4 Drawing Sheets

CHIMNEY BRUSH

BACKGROUND OF THE INVENTION

1. Field of the Invention

The present invention relates to chimney brushes, and more particularly pertains to a new and improved chimney brush which is mounted for reciprocation within the flue liner of a chimney. Over the course of usage, soot and creosote will accumulate on the inner surfaces of chimney flue liners. The problem is particularly acute when burning soft woods such as pine. If these deposits are not removed from the flue liner walls, a chimney fire is apt to be the result. In extreme cases, chimney fires can cause substantial damage to a chimney such as the breakage of the flue liners, and many houses have even been burned to the ground as a result of severe chimney fires. In order to overcome these problems, the present invention provides a chimney brush which is mounted between two pulleys within the flue liner of a chimney and is provided with a manual drive mechanism for reciprocating the brush along the length of the flue liner.

2. Description of the Prior Art

Various types of chimney brushes are known in the prior art. These conventional chimney brushes require the user to climb onto the roof of the house in order to manipulate the chimney brush down the interior of the flue liner. Other types of chimney cleaning systems have been utilized which require elaborate vacuum systems for collecting the material removed from the walls of the flue liner. In each case, the prior art devices require extensive assembly and are difficult to manipulate within the interior of the flue liner.

While the above mentioned devices are suited for their intended usage, none of these devices provide a chimney brush which is permanently mounted for reciprocation along the length of the flue liner of a chimney. Further, none of the aforesaid conventional chimney brush devices utilize a chimney brush which is mounted between spaced pulleys and manually driven for reciprocation along the length of the flue liner of the chimney. None of the prior art devices may be left installed within the flue liner when not in use. Inasmuch as the art is relatively crowded with respect to these various types of chimney brushes, it can be appreciated that there is a continuing need for and interest in improvements to such chimney brushes, and in this respect, the present invention addresses this need and interest.

SUMMARY OF THE INVENTION

In view of the foregoing disadvantages inherent in the known types of chimney brushes now present in the prior art, the present invention provides an improved chimney brush. As such, the general purpose of the present invention, which will be described subsequently in greater detail, is to provide a new and improved chimney brush which ha all the advantages of the prior art chimney brushes and none of the disadvantages.

To attain this, a representative embodiment of the concepts of the present invention is illustrated in the drawings and makes use of a chimney brush mounted on a cable loop between two pulleys within the flue liner of a chimney. A first pulley is mounted at the top of the chimney on a bracket attached to the chimney cap. A second pulley is mounted beneath the stove connection or thimbol, adjacent an access door in the chimney. The lower pulley is provided with a manually manipulated crank arm for reciprocating the chimney brush along the length of the flue liner. A spring connection between the cable and the chimney brush is provided to compensate for any stretching or expansion due to heating of the cable. The lower pulley is provided with a steep angled V groove configuration to ensure frictional driving engagement with the cable. When not in use, the chimney brush is positioned beneath the stove connection or thimbol and thus does not interfere with the passage of smoke through the upper portion of the flue liner.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chimney brush which has all the advantages of the prior art chimney brushes and none of the disadvantages.

It is another object of the present invention to provide a new and improved chimney brush which may be easily and efficiently manufactured and marketed.

It is a further object of the present invention to provide a new and improved chimney brush which is of a durable and reliable construction.

An even further object of the present invention is to provide a new and improved chimney brush which is susceptible of a low cost of manufacture with regard to both materials and labor, and which accordingly is then susceptible of low prices of sale to the consuming public, thereby making such chimney brushes economically available to the buying public.

Still yet another object of the present invention is to provide a new and improved chimney brush which provides in the apparatuses and methods of the prior art some of the advantages thereof, while simultaneously overcoming some of the disadvantages normally associated therewith.

Still another object of the present invention is to provide a new and improved chimney brush which is mounted for reciprocation within the flue liner of a chimney.

Yet another object of the present invention is to provide a new and improved chimney brush which is mounted between two pulleys for reciprocation along the length of a flue liner of a chimney.

Even still another object of the present invention is to provide a new and improved chimney brush which is permanently mounted within the flue liner of a chimney and, when not in use, is positioned below the stove connection or thimbol, and thus does not interfere with the passage of smoke through the flue liner of the chimney.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
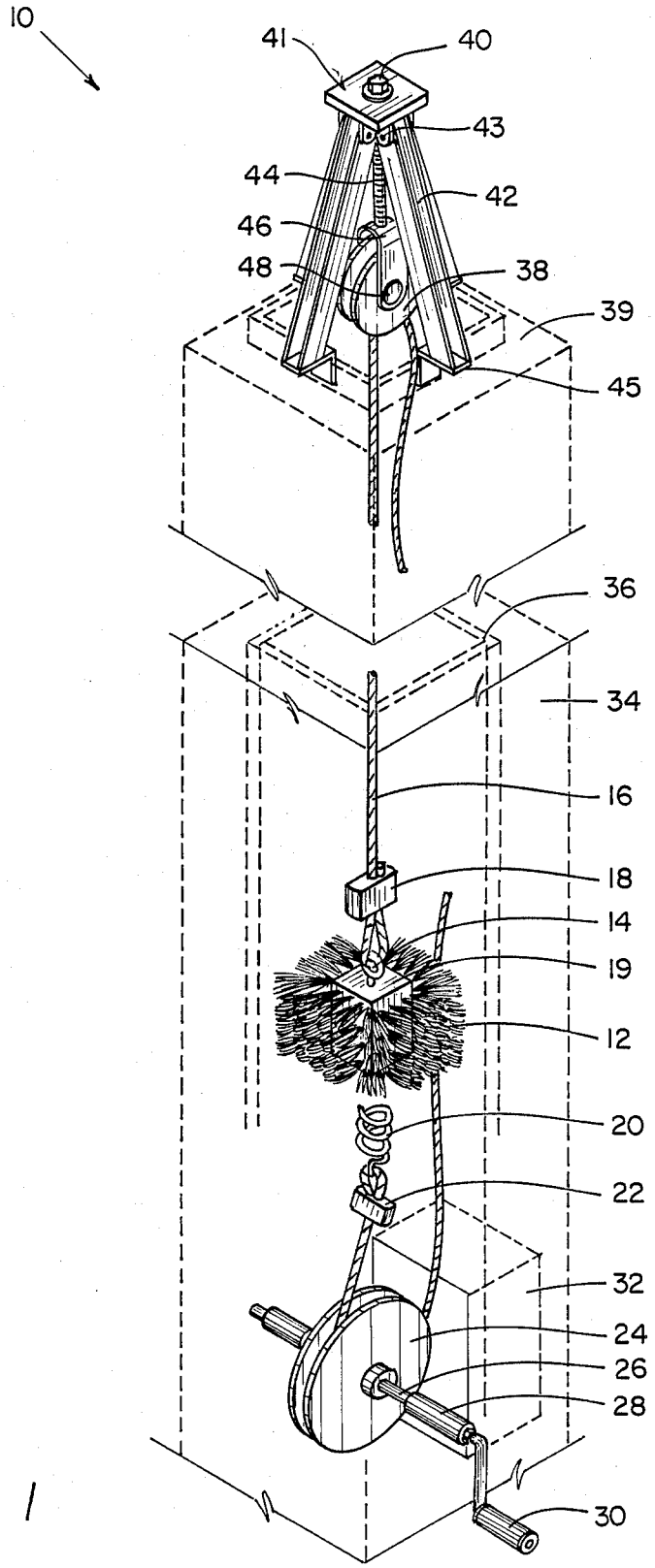
FIG. 1 is a perspective view of the chimney brush of the present invention mounted within the flue liner of a chimney.

With reference now to the drawings, and in particular to FIG. 1 thereof, a new and improved chimney brush embodying the principles and concepts of the present invention and generally designated by the reference numeral 10 will be described.

Figure 4:
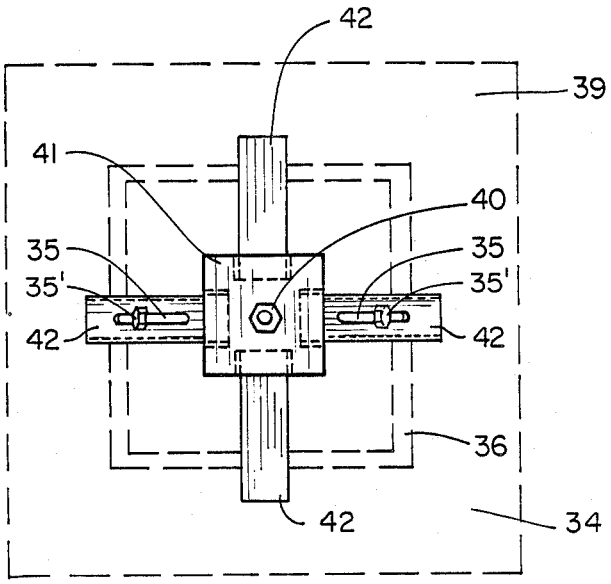
FIG. 4 is a top view of the upper pulley mounting bracket.

More specifically, it will be noted that the first embodiment 10 of the invention includes a plurality of radially extending bristles 12 attached to a brush block 19. A mounting loop 14 is threadedly secured to the brush block 19. A cable 16 is secured to the loop 14 by a conventional cable clamp 18. A coil spring 20 is secured by a similar mounting loop to the lower end of the brush block 19. An opposite end of the coil spring is secured to the cable 16 by another cable clamp 22. The cable 16 forms a continuous loop around a pair of spaced pulleys 24 and 38. The lower pulley 24 has a steep angled V groove and is secured for rotation with a transversely extending axle 26. The axle 26 is journaled for rotation in brass bearing sleeves 28 which extend through the masonry chimney wall 34 and flue liner 36. A handle 30 is provided on the axle 26 for rotation of the drive pulley 24. The drive pulley 24 is mounted adjacent a clean out door 32. It should be noted that the drive pulley 24 and clean out door 32 are mounted at a level in the chimney 34 beneath the fire box. Thus when not in use, the brush block 19 may be moved to a position beneath the stove connection or thimbol so that interference with the passage of smoke up the flue liner 36 will be minimized. The second idler pulley 38 is journaled for rotation on an axle 48 in a mounting block 46. The mounting block 46 is adjustably mounted by a threaded rod 44 on a four sided plate 41. The opposite sides of said plate are parallel with each other. A plurality of supporting legs 42 are pivotally attached at 43 to the plate 41. Each supporting leg is pivotally attached to the mid-portion of each side of the support plate as shown in FIG. 4. A nut 40 is provided on an upper surface of the plate 41 for securement of the threaded rod 44 in an adjusted position. A right angle flanged portion 45 is disposed at a lower end of each of the supporting legs 42. These flanged supports are inserted within the top of the flue liner 36 adjacent the chimney cap 39. By virtue of the pivoted connection 43 of each of the legs 42, the mounting arrangement is adjustable for use with various sizes of flue liners 36. The tension on the cable 16 forces the right angle flanges outwardly into engagement with the inner wall said flue linear. As is now readily apparent, by rotation of the crank 30 in one direction and then the other, the bristles 12 attached to the brush block 19 will be caused to reciprocate along the length of the flue liner 36, thus removing the accumulated deposits therefrom. These deposits will then fall to the bottom of the chimney where they may be removed through the clean out door 32. When not in use, the brush block 19 may be moved to a position adjacent the clean out door 32 so that only the cable 16 will remain in the active portion of the flue liner 36, thus minimizing the interference with smoke flow out of the chimney. It is contemplated that the cable 16, cable clamps 18 and 22, brush block 19, bristles 12, pulleys 24 and 38, and all other associated hardware will be constructed from a corrosion and heat resistant material, such as stainless steel painted with a high temperature corrosion resistant paint. This will ensure for a long service life of the chimney brush 10 of the present invention.

Figure 2:
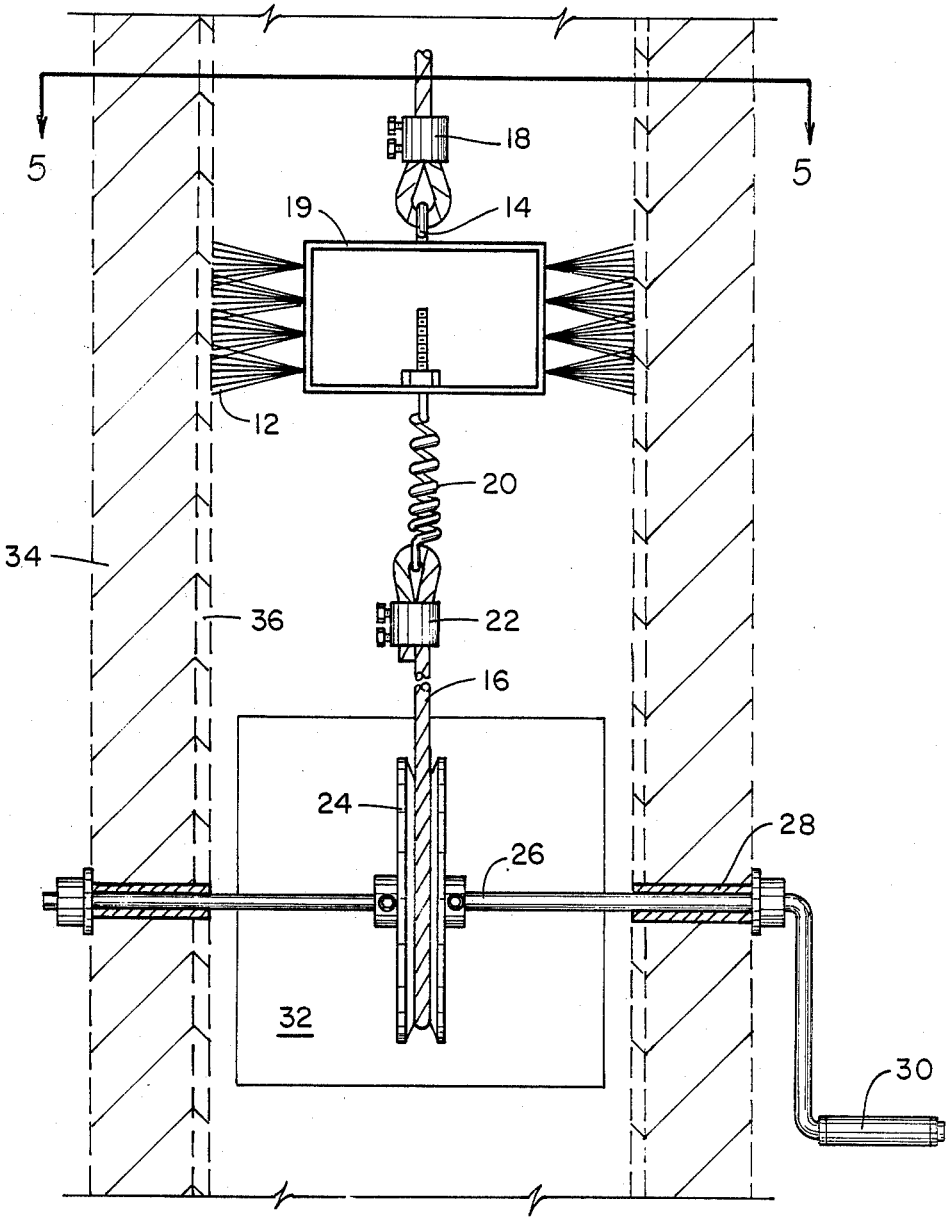
FIG. 2 is a longitudinal cross section of a chimney with the brush of the present invention mounted therein, illustrating the lower driving pulley.

In FIG. 2, the manner of connection of the spring 20 with the lower end of the brush block 19 is clearly illustrated. It should be noted that the pulley 24 has a steep angled V groove to ensure frictional driving engagement of the pulley 24 with the cable 16. The positioning of the brass bearing blocks 28 for the axle 26 adjacent the access door 32 assures easy access for the maintenance of the various components of the chimney brush 10 of the present invention. This arrangement also ensures that the brush block 19 may be replaced if necessary.

Figure 3:
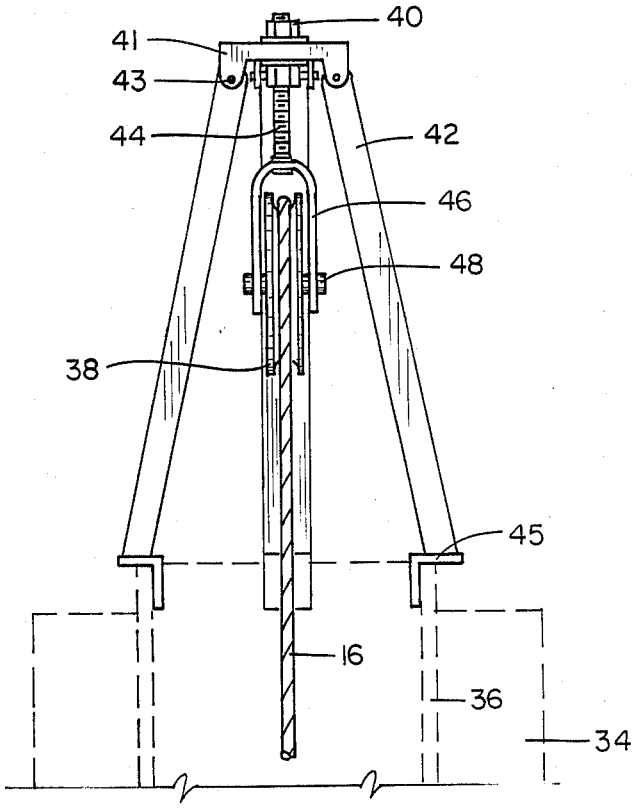
FIG. 3 is a side view illustrating the mounting of the upper pulley on a chimney cap.

As illustrated in FIG. 3, the threaded rod 44 is secured by a nut 40 to the mounting plate 41. This allows the height of the pulley mounting block 46 to be adjusted, thus providing a tension adjustment for the cable 16. The pulley 38 may be provided with a U shaped groove for the reception of the cable 16, as no driving engagement of the idler pulley 38 with the cable 16 is required. It may be understood that the mounting flange 45 on each of the support legs 42 may be disposed within the flue liner 36. A threaded mounting clamp may also be provided, but is not strictly necessary, because the tension between pulleys on the cable 16 serves to force each of the support legs 42 radially outwardly against the inner walls of the flue liner 36. This provides a secure mounting for the idler pulley 38 which may be utilized with a variety of different sizes of flue liner 36, without the necessity of manipulating any threaded fasteners.

As shown in FIG. 4, the mounting plate 41 and supporting legs 42 still allow a sufficient opening for the escape of smoke from the flue liner 36.

Figure 5:
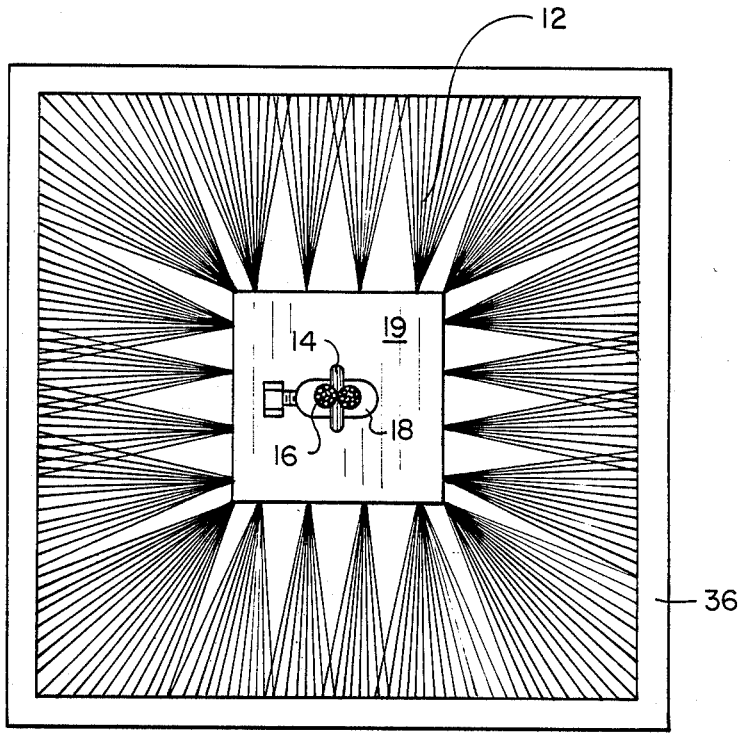
FIG. 5 is a cross sectional view taken along lines 5—5 of FIG. 2.

With reference now to FIG. 5, it may be seen that the brushes 12 extend radially outwardly from the brush mounting block 19 into engagement with the interior walls of the flue liner 36. This configuration of the brushes 12 ensures a complete removal of any accumulated deposits on the interior walls of the flue liner 36, and also serve to keep the brush block 19 centered therein. Conventional cleaning solvents may also be applied to the bristles 12 prior to a cleaning operation.

The chimney brush 10 of the present invention may be easily incorporated into the construction of a new chimney, or may be easily retrofitted to an existing chimney. An additional modification of the present invention includes the substitution of a coil spring for the threaded rod 44 in the mounting of the upper pulley 38. This alternative arrangement provides for additional tensioning of the cable loop 16. Additionally, it is contemplated that two of the support legs 42 will be provided with a two piece construction, one of the two pieces being slotted as at 35 and the other illustrated in phantom in FIG. 4, and each receiving bolts 35', allowing an adjustment to be made in the length of the legs to accommodate rectangular flue liners.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In a chimney having an elongated flue liner, and a clean out door disposed at a lower end of said flue liner, the improvement comprising:

brush means disposed within said flue liner;

cable means attached to opposed ends of said brush means;

said cable means attached to one end of said brush means by a coil spring;

first pulley means;

a four sided support plate having opposite sides parallel to each other;

four support legs, each leg pivotally attached adjacent one end to said support plate, a pair of oppositely disposed legs being adjustable in length to accommodate a rectangular flue liner;

a right angle flange on an opposite end of each of said support legs for engagement within said liner, each of said support legs being pivotally attached to a mid-portion of each side of said support plate such that tension in the cable means forces said right angle flanges outwardly into engagement with an inner wall of said flue liner;

a threaded rod extending centrally through said support plate and adjustably mounting said first pulley means on said support plate for axial movement;

second pulley means;

means rotatably mounting said second pulley means within a lower end of said chimney flue liner;

said cable means forming a loop around said first and second pulley means; and means for rotating said second pulley means in first and second opposite directions for reciprocating said brush means along the length of said chimney flue liner.

2. The chimney brush of claim 1, wherein said means for rotatably mounting said second pulley means comprises an axle extending transversely through said flue liner and brass bearing blocks extending through said flue liner journaling said axle for rotation.

3. The chimney brush of claim 2, further comprising a hand crank attached to said axle for manual rotation.

4. The chimney brush of claim 1, wherein said two adjustable length legs are each formed in a two piece construction, with one of the two pieces having a longitudinally extending slot for the reception of a clamping bolt for securing said two pieces in adjusted position.

* * * * *